US005393253A

United States Patent [19]

Humble et al.

[11] Patent Number: 5,393,253

[45] Date of Patent: Feb. 28, 1995

[54] INTERMENT VESSEL WITH DIRECTIONAL CAPABILITY

[76] Inventors: David R. Humble, 2696 Emerald Way North, Deerfield Beach, Fla. 33441; Hans A. Barth, 2600 NE 22nd St., Fort Lauderdale, Fla. 33305

[21] Appl. No.: 7,118

[22] Filed: Jan. 21, 1993

[51] Int. Cl.[6] ..... B63B 21/00

[52] U.S. Cl. ..... 441/32; 27/1

[58] Field of Search ..... 27/1; 114/39.1, 121, 114/140; 441/1, 32

[56] References Cited

U.S. PATENT DOCUMENTS

| | | | |
|---|---|---|---|
| 237,782 | 9/1880 | Townsend . | |
| 3,182,340 | 5/1965 | Gentile | 441/32 |
| 3,654,675 | 4/1972 | Peterson . | |
| 3,732,602 | 5/1973 | Vigh . | |
| 4,669,989 | 6/1987 | Havlick | 441/1 |
| 4,877,203 | 10/1989 | Harden . | |
| 4,927,394 | 5/1990 | Galgana | 441/1 |
| 4,966,279 | 10/1990 | Pearcy | 441/32 |
| 4,977,652 | 12/1990 | Graham . | |

FOREIGN PATENT DOCUMENTS

| | | | |
|---|---|---|---|
| 26992 | 6/1909 | Sweden | 441/1 |

*Primary Examiner*—Stephen P. Avila

*Attorney, Agent, or Firm*—Eckert Seamans Cherin & Mellott

[57] ABSTRACT

An interment vessel is designed to be capable of transoceanic travel. A body for the vessel is buoyant and self-righting. The vessel has a sail disposed diagonally across its upper surface, relative to a keel along the bottom, providing propulsion under power of prevailing winds. Crematory ashes can be placed in the body of the vessel, either into an opening in the body which is thereafter sealed, or into a sealable container or urn arranged to be carried by the vessel. A provision to store and display a removable reward can be provided as an incentive for a finder of the vessel to return the vessel or the container/urn to the decedent's family or the like. Instructions can be provided, for example detailing the address and mentioning a further reward.

17 Claims, 3 Drawing Sheets

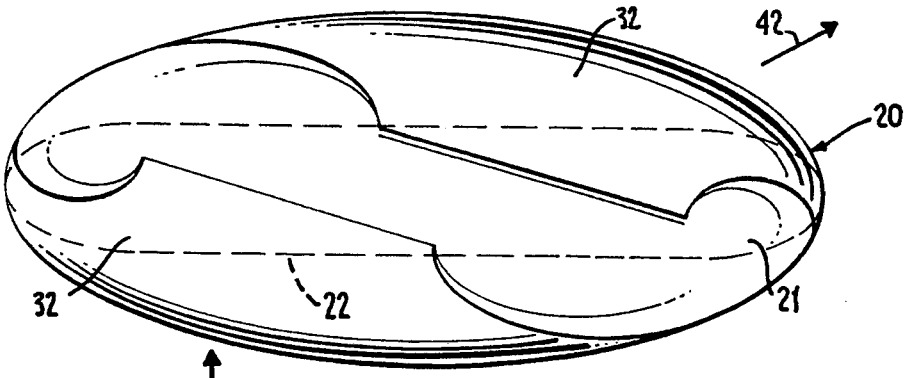
FIG. 1.
FIG. 2.
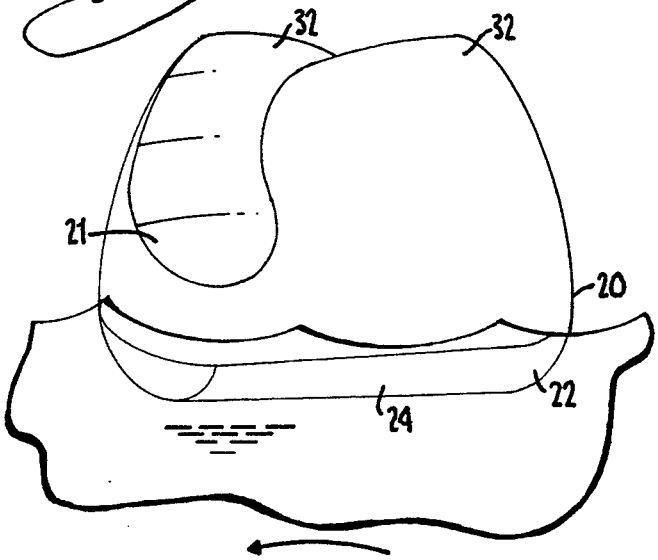
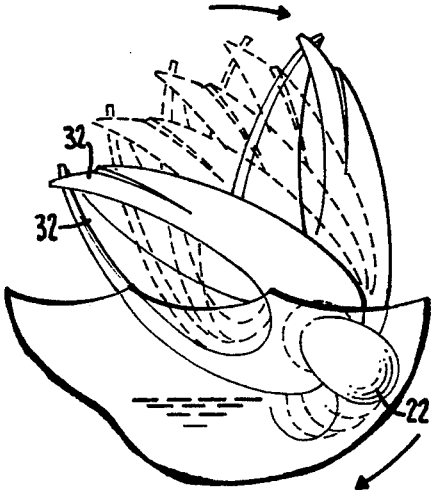
FIG. 3a.
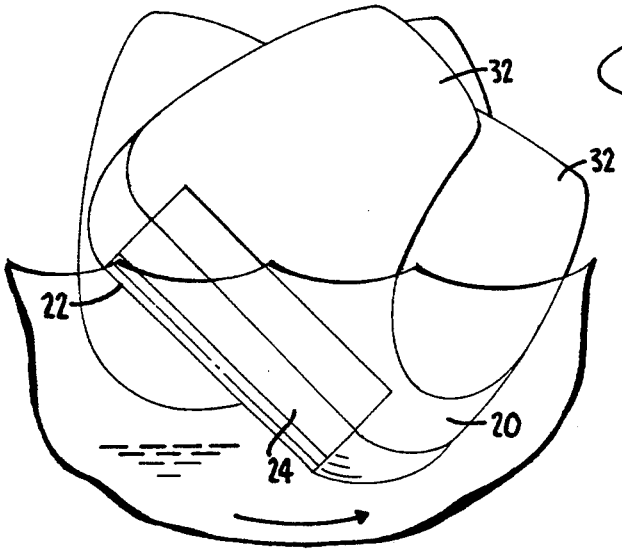
FIG. 3b.

INTERMENT VESSEL WITH DIRECTIONAL CAPABILITY

BACKGROUND OF THE INVENTION

1. Field of the Invention

This invention relates to a vessel for holding crematory ashes, and more specifically a vessel for holding crematory ashes that sails on a body of water via sail and keel appendages, so as to be carried by prevailing winds.

2. Description of the Prior Art

When people die they generally either are buried or cremated. Burial is preferred by some people who believe that cremation may destroy a soul or spirit that survives after death. Burial is also sometimes preferred since cemeteries are typically well kept landscaped fields that are aesthetically pleasing. The surviving loved ones of the deceased take pleasure in knowing that the deceases rests in a placid, beautiful place with trees and flowers as well as rabbits, squirrels, birds, etc. Furthermore, the grave site provides a place for the remaining loved ones to come to pay their respects, and to remember the deceased. The aesthetic and peaceful character of the grave site makes it easier for surviving loved ones to cope with the death.

On the other hand, many people are cremated after death. Cremation is advantageous over burial since cremation does not require that parcels of land be devoted to receiving caskets and gravestones. The crematory ashes which remain may be simply placed in an urn which the surviving loved ones place in a suitable place such as on a mantle or shelf in their home for remembrance of the deceased.

An urn discussed above for holding crematory ashes is disclosed in U.S. Pat. No. 3,654,675—Peterson. Peterson discloses a burial urn constructed of plastic material. The urn has a closed end and an open end that is closeable by a plastic cover.

Peterson discloses a practical urn design. A more ornamental urn may be more desirable as a fitting receptacle for the remains of a deceased loved one. For example, U.S. Pat. No. 237,782—Townsend discloses a statue-like urn for receiving crematory ashes, namely a bust. Preferably the bust is a likeness of the deceased person. A receptacle in the back is provided for receiving the ashes and is closable by a removable plate.

Another advantage of cremation over burial is that the surviving loved ones have flexibility with respect to the disposition of the ashes. For example, as noted above, the ashes may be placed in container and kept in the loved ones home so that the survivors have a near and tangible reminder of the deceased.

U.S. Pat. No. 4,977,652—Graham discloses a hybrid of cremation and burial. Graham discloses a tree forest cemetery. Ash-containing urns are introduced to an underground vault through a surface tunnel. The vault is constructed beneath a tree, or alternatively the tree is planted over the vault after the ground is excavated and the vault installed. The tree is appealing as a continuing life associated with the deceased.

Other people wish to be cremated so that their ashes may be scattered or disposed in a particular place. For example, an outdoorsman may become particularly attached to a certain mountain range, riverbank or some other parcel of land during his lifetime and it seems fitting that his remains be placed there. A sea-going person, such as a sailor or yachtsman may be particularly fond of the sea or a river or a certain section of the sea or river. In all of the above cases, the person may wish that his crematory ashes be scattered about the geographic area he knew while alive. When ashes are scattered, the remaining loved ones do not have a fixed burial site, urn or other tangible thing to associate with the deceased. This is offset, however, by the fact that they have released the deceased into a favorite place, which they may also visit.

Leaving the deceased in his favorite earthly place may be of little moment to the deceased; but at least the remaining loved ones achieve a sense of warmth and peace for complying with the wishes of the deceased, and the knowledge that he is in the place that he loved the most.

Devices facilitating ash disposal at preferred geographic locations are known. U.S. Pat. No. 3,732,602—Vigh discloses a submersible urn for burial at sea. The urn has a weighted bottom and ports surrounding its top. When placed in the ocean, the weighted bottom forces the urn to sink. The ports admit water to the interior, and the urn sinks to the ocean floor. The urn, as well as its contents, eventually disintegrate.

U.S. Pat. No. 4,877,203—Harden discloses a device for spreading crematory ashes from the air. The disclosure includes a vent mechanism disposed through the cockpit wall of an airplane. The ashes are loaded from the interior of the cockpit and released in the air through the vent. Alternatively, the ashes are contained in a burlap bag which is hung out of the cockpit window for release of the ashes in the sky.

Cremation and the scattering of the deceased's ashes has drawbacks in that upon scattering of the ashes the surviving loved ones finally depart with all tangible evidence of the deceased. Many survivors find that visiting a cemetery or viewing a burial urn containing crematory ashes is cathartic and important in overcoming the sense of loss accompanying the death of a loved one. When scattering the ashes of the loved one, there is of course no expectation that any vestige of the loved one will return.

There is a need for an interment device, at least for the benefit of the survivors, which retains the emotional benefits of dispersing the decedent's remains, e.g., sending the deceased to visit exotic far away places, or to occupy a favorite body of water after death, but wherein the survivors have a tangible item initially, as well as some expectation that after the deceased is dispatched this tangible item eventually will return the deceased to his loved ones for enshrinement. This need is satisfied by the device of the invention.

SUMMARY OF THE INVENTION

It is a general object of this invention to provide an urn for placement of crematory ashes.

It is another object of the invention to make the urn water-tight and buoyant for sailing the ashes to a predetermined location.

It is a further object of the invention to provide for recovery and return of the ashes from a remote location for suitable disposition.

These and other objects are accomplished by an interment vessel with directional capability. The interment vessel has or defines an openable watertight ash containment urn. The vessel has a main body with one or more protrusions defining at least one sail, and a keel.

The sail intersects at a right angle with the upper surface of the main body and is inclined relative to the keel so as to sail at a reach. When released in the water the vessel sails in the prevailing wind and current, to an eventual destination. The vessel can include instructions to the finder of the vessel and can provide for a reward in exchange for, or in anticipation of, return of the remains to the loved ones who dispatched them.

BRIEF DESCRIPTION OF THE DRAWINGS

There are shown in the drawings the embodiments of the invention as presently preferred. It should be understood that the invention is capable of other embodiments and combinations of elements in accordance with the scope of the invention claimed. In the drawings, FIG. 1 is a top plan view demonstrating the directional capability of the interment vessel according to the invention.

FIG. 2 is a top perspective view showing the interment vessel travelling through the water.

FIGS. 3*a* and 3*b* are diagrammatic views substantially from a front (or rear) and side of the vessel, respectively, demonstrating the self-righting capability of the interment vessel.

DETAILED DESCRIPTION OF THE PREFERRED EMBODIMENTS

Figure 4A:
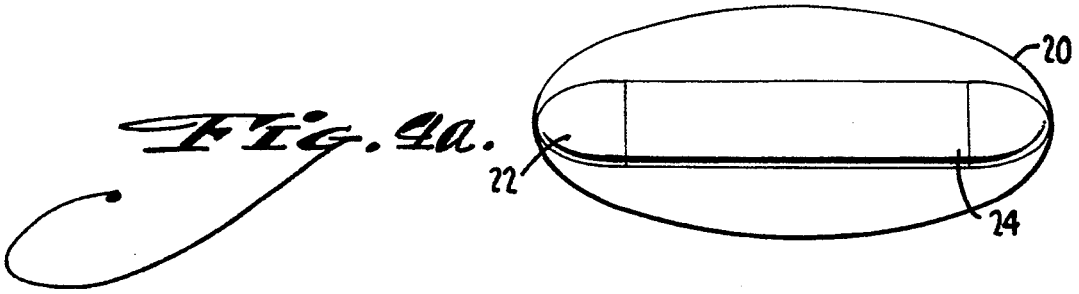
FIGS. 4*a*–4*c* are bottom plan, side and end elevation views showing a preferred shape of the vessel, the bottom view showing the keel outline and the main body contour; the side view showing the main body, sails and container (urn); and the front view showing the main body with two sails forming a slot and a keel contour with a container thereunder.
Figure 4B:
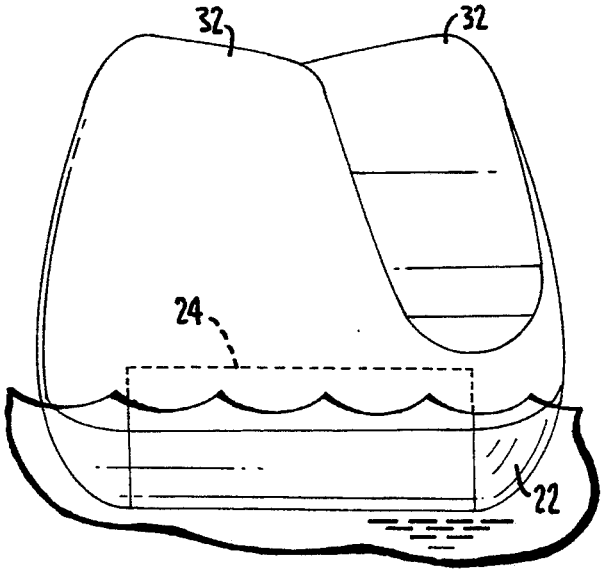

The invention comprises a floating interment vessel with directional capability including a floating vessel having a repository for receiving crematory ashes. The vessel can be placed on a body of water having either or both of wind and water current. Sail and keel appendages are provided for interaction with the wind and water currents, providing for propulsion and stability as needed to transport the remains to a destination where they preferably are recovered and returned.

Referring to FIGS. 1 and 2, the preferred interment vessel according to the invention has a buoyant body 20. In the preferred embodiment, this body 20 is substantially oval, although other shapes are possible within the scope of the invention. In the preferred embodiment, the body 20 is constructed or encased in a seaworthy, non-corrosive material such as titanium or ceramic. Other durable materials could also be used.

At least one sail 32 is attached to the upper surface 21 of the body 20. In the preferred embodiment shown in FIGS. 1 and 2, two sail members are arranged in mirror symmetry. Under a prevailing wind, the vessel advances in one direction or the other relative to the longitudinal axis of the vessel as a result of the wind, developing high and low pressure areas as shown in FIG. 1. The sails as thus arranged cause the vessel to proceed on a broad reach. In the embodiment shown, the sails 32 are integral with the body 20 and disposed diagonally across the upper surface 21 of the body 20 relative to the longitudinal axis defined by the keel 22.

The keel 22 depends downwardly from the body 20 and is elongated relative to the body for guiding the vessel in the water. Keel 22 can be continuously integral with the body 20, or can be defined in part by a removable container or urn 24 that is likewise elongated. The keel 22 provides a relatively greater weight distribution at the lowermost point in the vessel and is designed to stabilize the vessel as well as to interact with the water and with currents in the water to provide propulsive force and to guide the vessel. As shown in FIGS. 3*a* and 3*b*, the weight of the keel will right the vessel if pitched around a lateral axis or rolled around a longitudinal axis, rendering the vessel self-righting.

FIG. 1 shows the vessel moving through the water. The diagonal placement of the sails 32 relative to the longitudinal axis of the keel 22 is such that the vessel proceeds as a sailboat. A wind, for example in direction 40, causes a low pressure area on the side of the sail opposite the side on which the wind is incident. The keel 22 restricts movement of the vessel in the water, favoring advance in a longitudinal direction. As the vessel moves in a direction along its axis, the apparent wind is shifted around toward the front, passing along the curved leading edge of the sail to increase the pressure differential on opposite sides of the sail. The vessel will move in direction 42, i.e., on a broad reach. The vessel is mirror image symmetrical from end to end, and therefore can be faced in either direction with the same effect.

Figure 5:
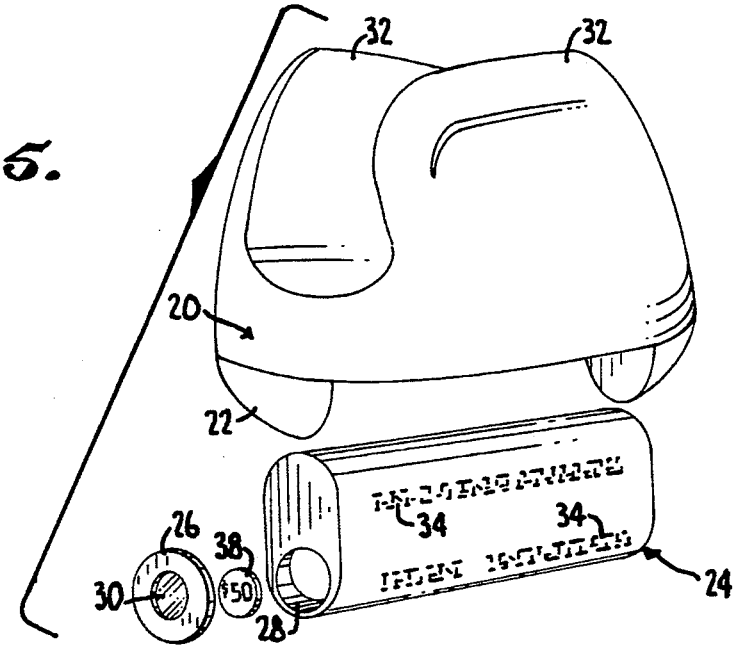
FIG. 5 is a perspective view of the interment vessel with its container (urn) shown removed downwardly and a reward (e.g., a coin) shown removed from its holding recess.

Referring also to FIG. 5, a container or urn 24 preferably is attached at the lowermost part of the keel 22. The container 24 can be openable, for example, via a removable cap 26 at one end, to permit access to the interior of the container or urn 24, for loading crematory ashes into container 24 and for later removal thereof. In the preferred embodiment, the removable cap 26 is sealed after the crematory ashes are placed within the container or urn 24, exclusing water as well as preventing unauthorized access to the ashes by a finder of the vessel. Other methods of preventing access, such as a locking cap, are also possible.

As an optional feature of the invention, a reward can be provided, as an incentive for the finder to return the remains to the loved ones. An additional reward may be provided for and mentioned on instructional indicia associated with the vessel, e.g., to be awarded to the finder after the remains are returned, as a further incentive for the finder to return the remains notwithstanding access to the reward directly associated with the container/urn. For example, the reward can be contained in a subchamber of the container (urn) 24, in its cap, or in another place conveniently associated with the urn and/or the vessel. Preferably the reward is visible, labeled or otherwise manifested, to draw the attention of the finder thereto.

Instructions 34 to be read by the finder of the vessel may be printed on or attached to the exterior of the container 24, for example if it is removable from the vessel. Alternatively, the entire vessel can be returnable with its contents, in which event the receptacle for the ashes can be a sealable void in the interior of the vessel, which can be integral rather than having an associated removable container as shown.

The container (urn) 24 can be made detachable from the vessel, for example being mounted in the vessel via a snap fit, pop-out arrangement, mechanical release, etc. Alternatively, the urn can be a permanent part of the vessel, either being integral with the vessel or affixed to the vessel so as to remain in place.

Figure 4C:
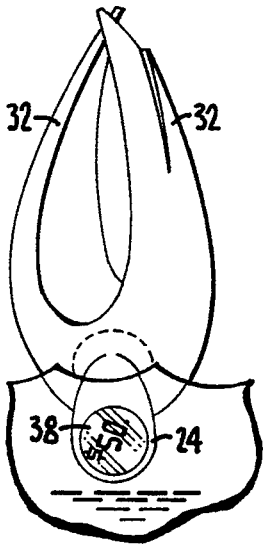

An optional reward can encourage a person finding the vessel to take appropriate action, for example to return at least the container/urn portion 24 to a stated address. FIGS. 4*c* and 5 show a reward carried at the closed end of the container 24, for example in a holder or subchamber 28 associated with the cap of the container. The reward preferably is readily apparent to a person who may find the vessel (or the container, if removable), for example being labeled or visible through a transparent window 30 or otherwise manifested. The window 30 in the reward housing 28 permits the finder to see the reward 38 inside. The reward 38 can be a gold coin, for example, or some other token which is recognizable in virtually any culture as valuable. Other rewards could also be used, and as noted above, additional incentive can be provided if the reward is collectable in stages.

The finder's reward 38 can be stored in various means that protect the reward from deterioration in sea water or the like, and allow the finder access. For example, a removable housing for the reward can be detachable from the container/urn 24, or otherwise carried on the vessel. Preferably, access to the reward does not require the finder to interfere unnecessarily with the urn.

The deceased may have previously expressed a specific desire that his remains be handled according to the invention, e.g., specifying this desire in a will or in a conversation. Alternatively, the deceased's loved ones may determine that the deceased would have wished to use this invention to visit a favorite vacation spot or a far-off land which he had never experienced in life.

The loved ones place the crematory ashes of the deceased into the container of the interment vessel. This may be done as part of the memorial service for the deceased or at another point in time. The container is sealed or locked.

Figure 6:
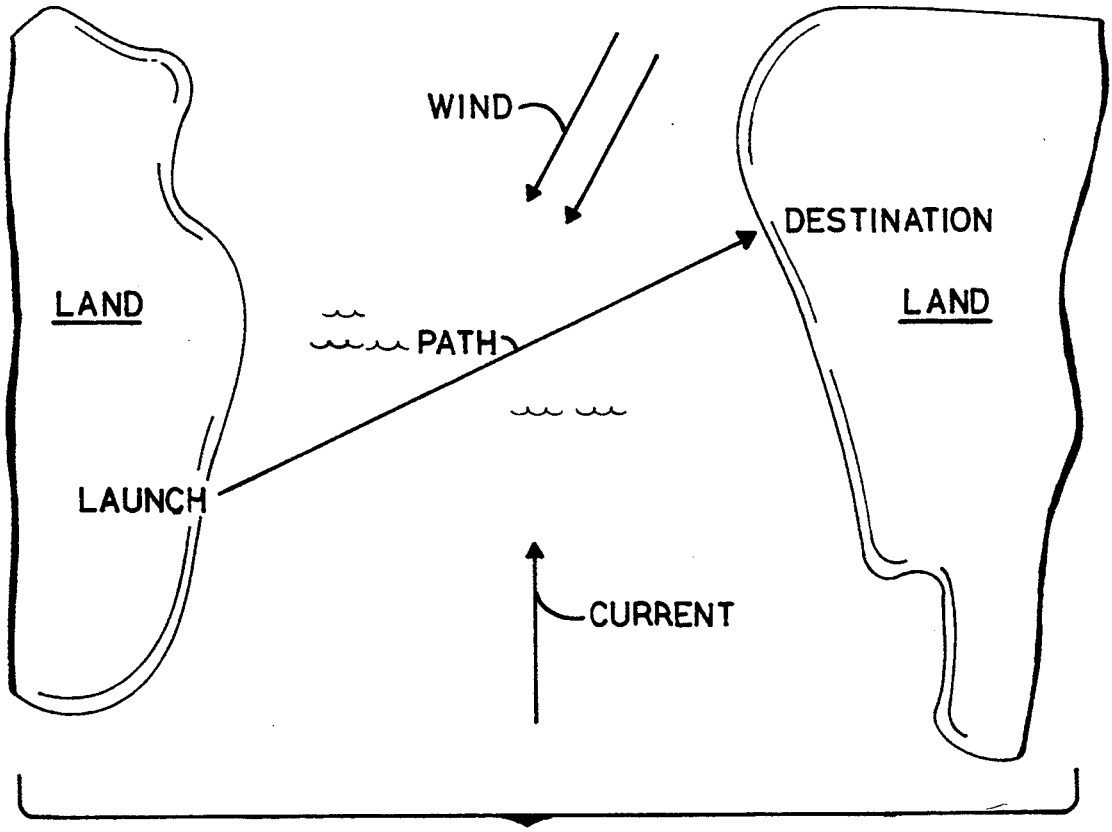
FIG. 6 is a map illustrating determining from prevailing wind and water currents a proper embarkation location for depositing the container, whereby the ashes are propelled thereby to a desired location.

The loved ones may plan for a particular destination for the final voyage of the deceased, by noting prevailing oceanic currents and wind patterns and determining the place at which the interment vessel should be launched to increase the likelihood that the vessel will reach the intended destination, as shown in FIG. 6. This launch place might be the beach of an ocean or the Gulf of Mexico. Rivers, sounds, and other bodies of water which empty into the oceans can also be used. A scenic or otherwise appealing destination is normally chosen, so that the aesthetic surroundings provide comfort to the survivors and loved ones gathered for the launching.

An appropriate time also can be determined based on seasonal currents, weather patterns, and tidal schedules. The date and time likewise are selected for the convenience of loved ones who wish to attend the launching ceremony, while maximizing the likelihood that the deceased will arrive at the intended destination.

The loved ones may wish to determine what languages are spoken and read in the destination and its vicinity to ensure that instructions provided for return of the container or urn are understandable to prospective finders.

At the chosen time, the loved ones meet at the launch site. A ceremony commemorating the deceased could be held, and prayers and wishes conveyed for his safe journey. The interment vessel is then launched, giving the loved ones an inner sense of peace and tranquility as they watch the vessel sailing off on its voyage, assisting in the emotional recovery of the loved ones, without wholly letting go of the deceased.

The interment vessel would then be on its way to its destination, directed by both wind and water currents. The crematory ashes of the deceased are protected by the non-corrosive material and watertight structure of the vessel. The vessel is weighted so as to be self-righting. If the vessel should be capsized by rough seas, it will turn upright due to its relatively greater bottom weight or ballast and the journey thus continues due to the self-righting characteristics of the vessel design.

In time, the vessel washes up on land. A passerby who finds the vessel can learn about any mail-back reward offered from the instructions. The passerby will hopefully act on the instructions, e.g., by removing the container (and the on-board reward), and mailing the container to the noted address. As noted above, it is also possible that the entire vessel could be returned.

The instructions can also inform the finder as to the contents of the container and dissuade him from trying to open it in the hope of finding something of monetary value. The finder can be prevented from disturbing the contents of the container by sealing the removable cap or by providing a locking cap, the key to which is retained by the loved ones during the journey of the vessel.

The instructions also can describe to the finder the method of detaching the container from the remainder of the vessel and returning it to the address shown. Postage would be prepaid by the loved ones. By following the instructions, the finder can easily return the remains of the deceased to his loved ones.

Upon receipt of the deceased's ashes, the loved ones can make an appropriate disposition, such as transferring the ashes to a more traditional urn for final interment, scattering the ashes at a preferred location, or choosing another alternative such as retaining the ashes at home, either in another receptacle or in the container of the invention.

While the focus of this description has been limited to human remains, such description is exemplary only and is not intended to limit the scope of the invention claimed. It should be clear that various sizes of the disclosed vessel could be utilized to accommodate animals such as dogs, cats, birds, horses, or others.

Similarly, alternative embodiments could accommodate a plurality of persons' remains, such as spouses, families, or groups who might wish their remains to embark on a journey together after death.

The invention having been disclosed, additional variations will become apparent. Whereas the invention is reasonably intended to encompass the preferred arrangements disclosed as examples as well as a range of variations, reference should be made to the appended claims rather than the foregoing discussion of examples, in order to assess the scope of the invention in which exclusive rights are claimed.

What is claimed is:

1. A floating interment vessel with directional capability comprising:

a floating vessel having top and bottom sides and having receiving means for receiving crematory ashes, said vessel placeable on a body of water having at least one of wind and water current;

sail means rigidly affixed to said top side; and, keel means rigidly affixed to said bottom side, the sail means and the keel means being permanently set at a fixed angle relative to one another such that said vessel is propelled in a predetermined direction when subjected to the wind, at least one of said sail or keel means interacting with said at least one of wind and water current to propel said vessel through said body of water in the predetermined direction.

2. The vessel of claim 1, wherein the receiving means are defined at least partly by an inner wall of the vessel.

3. The vessel of claim 1, wherein said receiving means comprises a hollow container that is carried by the vessel.

4. The vessel of claim 3, wherein the vessel defines a directional keel, and wherein the hollow container is fixed in the vessel at the directional keel.

5. The vessel of claim 1, further comprising means on the vessel for housing a reward.

6. The vessel of claim 5, further comprising means on the vessel for visibly manifesting presence of the reward.

7. A floating interment vessel with directional capability, comprising:

an upper section, said upper section containing buoyant material and at least one rigidly affixed sail means for interacting with a wind current;

keel means rigidly affixed and downwardly depending from said upper section, said keel means for interacting with a water current, the sail means and the keel means being permanently set at a fixed angle relative to one another such that said vessel is propelled in a predetermined direction when subjected to the wind current; and, receiving means for receiving crematory ashes.

8. The vessel of claim 7, wherein said receiving means is defined by a chamber in the vessel.

9. The vessel of claim 7, wherein said receiving means is defined by a container received in the vessel, the container being removable from the vessel.

10. The vessel of claim 9, wherein said container is removable from said upper section.

11. The vessel of claim 7, further comprising instructions associated with the vessel for instructing a finder on disposition of the container.

12. The vessel of claim 7, wherein said upper section is essentially three-dimensional, said buoyant material disposed within said upper section.

13. The vessel of claim 7, wherein said upper section is essentially sealed and buoyant.

14. The vessel of claim 13, wherein said sail means is disposed diagonally relative to the keel means and protrudes upwardly from said upper section.

15. The vessel of claim 7, wherein said vessel is weighted so as to be selfrighting in the event said vessel is flipped.

16. A method for the disposition of crematory ashes, comprising:

providing a floating, water-tight container for the ashes, said container having rigid sail means disposed on a top side of said container and rigid keel means disposed on a bottom side of said container, said sail and keel means being permanently set at a fixed angle relative to one another such that the container is propelled in a predetermined direction when subjected to a wind current; and, using prevailing wind and water currents to propel the crematory ashes to a desired location.

17. The method of claim 16, further comprising the step of determining from prevailing wind and water currents a proper embarkation location for depositing the container, whereby the ashes are propelled thereby to a desired location.

* * * * *